US006264382B1

(12) United States Patent
Buxton et al.

(10) Patent No.: US 6,264,382 B1
(45) **Date of Patent: *Jul. 24, 2001**

(54) METHOD OF PRINTING

(75) Inventors: Keith Buxton, Mapperley Plains; Philip Hart, Nuthall, both of (GB)

(73) Assignee: Markem Technologies Limited, Nottingham (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/275,298

(22) Filed: Mar. 24, 1999

(30) Foreign Application Priority Data

Mar. 26, 1998 (GB) ..... 9806380

(51) Int. Cl.[7] ..... B41J 2/315

(52) U.S. Cl. ..... 400/120.01; 400/120.09; 400/120.11; 347/188; 347/191

(58) Field of Search ..... 400/120.01, 120.09, 400/120.1, 120.11; 347/211, 171, 188, 191, 183

(56) References Cited

U.S. PATENT DOCUMENTS

| | | | | |
|---|---|---|---|---|
| 4,216,480 | | 8/1980 | Buehner et al. | 346/75 |
| 4,586,835 | | 5/1986 | Alexander et al. | 400/121 |
| 4,683,479 | * | 7/1987 | Horiya et al. | 347/188 |
| 4,789,870 | * | 12/1988 | Lacord et al. | 347/211 |
| 5,149,212 | | 9/1992 | Murakami | 400/121 |
| 5,661,514 | * | 8/1997 | Lukis et al. | 347/211 |
| 5,675,370 | | 10/1997 | Austin et al. | 347/188 |

FOREIGN PATENT DOCUMENTS

| | | | |
|---|---|---|---|
| 0 331 033 A2 | 9/1989 | (EP) | G06K/15/10 |

OTHER PUBLICATIONS

Yumiko, H., "Printing Method," publication No. 62170358; publication date Jul. 27, 1987; 1 page; Patent Abstracts of Japan.

* cited by examiner

*Primary Examiner*—John S. Hilten
*Assistant Examiner*—Mina Chau
(74) *Attorney, Agent, or Firm*—Fish & Richardson P.C.

(57) ABSTRACT

A method of printing using a thermal print head comprises a plurality of printing elements arranged generally in an array each of which may selectively be energised and de-energised under the control of a control means to transfer pixels of marking medium from a carrier onto a substrate or to activate pixels on a sensitive substrate, the method comprising providing to the control means data dependent on the nature of the image to be printed which would enable the image having an image length L to be printed as a matrix of pixels at a linear resolution of C where C is the number of image columns per unit length in the direction of printing, wherein the method comprises causing relative movement between the print head and the substrate such that the print head relatively traverses the substrate the image length L in an available time T whilst the print head performs E thermal cycles to print the image, and the control means manipulating the data so that the image is printed with the print head omitting or repeat printing at least some of the columns of pixels so that the image has Z columns per unit length.

15 Claims, 1 Drawing Sheet

METHOD OF PRINTING

BACKGROUND TO THE INVENTION

This invention relates to a method of printing and more particularly to a method of printing which utilises a print head comprising a plurality of printing elements arranged generally in a row each of which may selected, and energised and de-energised, under the control of a control means to transfer a pixel of marking medium from a carrier onto a substrate or to activate pixels of a sensitive substrate, and which, during a printing operation, the print head and the substrate are relatively moved in a direction generally transverse to the row of printing elements.

DESCRIPTION OF THE PRIOR ART

Conventionally, the relative movement between the print head and the substrate is stepped, and the selected printing elements are energised and de-energised for each step of relative movement. Thus an image is printed in each printing operation having a resolution of R times C where R is the number of printing elements in a row per unit length and C the number of columns of pixels per unit length which conventionally is the same as the number of steps of relative movement. R and C are usually expressed in dots per inch (dpi).

The maximum printing speed i.e. the speed at which the printing operation may be carried out, is restricted by the ability of the print head to undergo thermal cycles each involving energisation (heating), for a sufficient time for a pixel of marking medium to be melted or at least softened or a pixel of a sensitive substrate to be activated, and de-energisation (cooling). High speed thermal print heads are able to undergo a thermal cycle down to about 1/6000 second so that a 300 dpi image can be printed at a speed of about 500 mm length per second.

Such thermal cycle time can be reduced by improved print head design, or improvements in the transfer medium characteristics, but there is a finite thermal cycle time.

Thermal print heaters could alternatively be driven by a synchronous motor which moves the print head continuously, not in stepped fashion. Again though, the printing speed is conventionally limited by the ability of the thermal print head to undergo thermal cycles, in order to produce an image to a particular resolution.

Another problem with conventional thermal printers occurs where such printers are used, for example in a production line environment where substrates such as articles which are to be printed upon, pass through a printing station whilst printing is effected by a stationary print head, or where the articles arriving at the printing station are held stationary whilst printing is performed by a moving print head. In the former case, constancy of speed of the articles cannot be guaranteed such that one article may pass through the printing station at one speed and a second article at a different speed. In the latter case, less time may be available for one article to dwell at the printing station than for a different article.

Thus in some instances insufficient time may be available for a print head to perform the necessary number of thermal cycles to print the image to a desired resolution, whilst in other instances too much time may be available for the print head, which is designed for high speed operation, to undergo the necessary number of thermal cycles without affecting the performance of the print head. For example if too much time is available for printing one image the thermal cycle time for future printing operations may be affected.

SUMMARY OF THE INVENTION

According to one aspect of the invention we provide a method of printing using a thermal print head comprising a plurality of printing elements arranged generally in an array each of which may selectively be energised and de-energised under the control of a control means to transfer pixels of marking medium from a carrier onto a substrate or to activate pixels on a sensitive substrate, the method includes providing to the control means data dependent on the nature of the image to be printed which would enable the image having an image length L to be printed as a matrix of pixels at a linear resolution of C where C is the number of image rows per unit length in the direction of printing, wherein the method comprises causing relative movement between the print head and the substrate such that the print head relatively traverses the substrate the image length L in an available time T whilst the print head performs E thermal cycles to print the image, and the control means manipulating the data so that the image is printed with the print head omitting or repeat printing at least some of the columns of pixels so that the image has R rows per unit length and Z columns per unit length.

Thus the thermal print head may be operated to print the image faster than would otherwise be possible albeit at the expense of resolution, when this is necessary because the time available to print the image is insufficient to enable the print head to perform the necessary number of thermal cycles to print the image to a full resolution. Where the time available for printing the image is long, the thermal print head may be operated to perform a thermal cycle more often than is necessary to print a full resolution image, to avoid the problem of affecting the performance of the print head during subsequent printing operations.

If the print head is thermally cycled twice in one column position, the image produced may have a linear resolution of C but usually the number of columns of pixels printed per unit length Z is not equal to the number of columns C per unit length contained in the data provided to the control means.

In one arrangement relative movement between the print head and the substrate is performed in stepped manner, e.g. by a stepper motor or the like, the control means relatively stepping the print head A times to move the print head the image length L in the time available to print the image, where A is not equal to the number of thermal cycles E performed by the print head in the time available T.

For example where the number of steps of movement of the print head A is greater than the number of thermal cycles E performed by the print head in the available time T to print the image the control means manipulates the data to omit columns of pixels from the image so that the resultant image has a reduced image linear resolution of Z. However where the number of steps of movement of the print head A is less than the number of thermal cycles E performed by the print head in the available time T to print the image the control means manipulates the data to repeat print at least some of the columns of pixels so that the resultant image may have a linear resolution of C.

In another embodiment the relative movement between the print head and the substrate is constant during the available time T to print the image. This may achieved by moving the print head relative to the substrate by a synchronous motor, or by moving the substrate past the print head.

In each case where the available time T to print the image is greater than that required by the print head to perform sufficient thermal cycles to print an image to linear resolution C, the control means may manipulate the data to cause columns of pixels to be repeat printed along the image length L so that Z is greater than C. Alternatively where the available time T to print the image is less than that required for the print head to perform C thermal cycles per unit length, the control means may manipulate the data to omit at least some of the, columns of pixels so that a reduced resolution image is produced.

According to a second aspect of the invention we provide a printing apparatus comprising a thermal print head having a plurality of printing elements arranged in an array each of which may selectively be energised and de-energised under the control of a control means to transfer pixels of marking medium from a carrier onto a substrate or to activate pixels on a sensitive substrate, means to cause relative movement between the print head and substrate in a printing direction whilst the thermal print head performs thermal cycles to print an image of image length L, wherein the control means is adapted to control the apparatus to perform a method of printing according to the first aspect of the invention.

It is desirable to be able to print faster particularly where the printer is a so called over printer which may be positioned in a production or packaging line which operates more quickly than an over printer conventionally is able to print.

BRIEF DESCRIPTION OF THE DRAWINGS

The invention will now be described with reference to the accompanying drawings in which.

DESCRIPTION OF THE PREFERRED EMBODIMENTS

Figure 1:
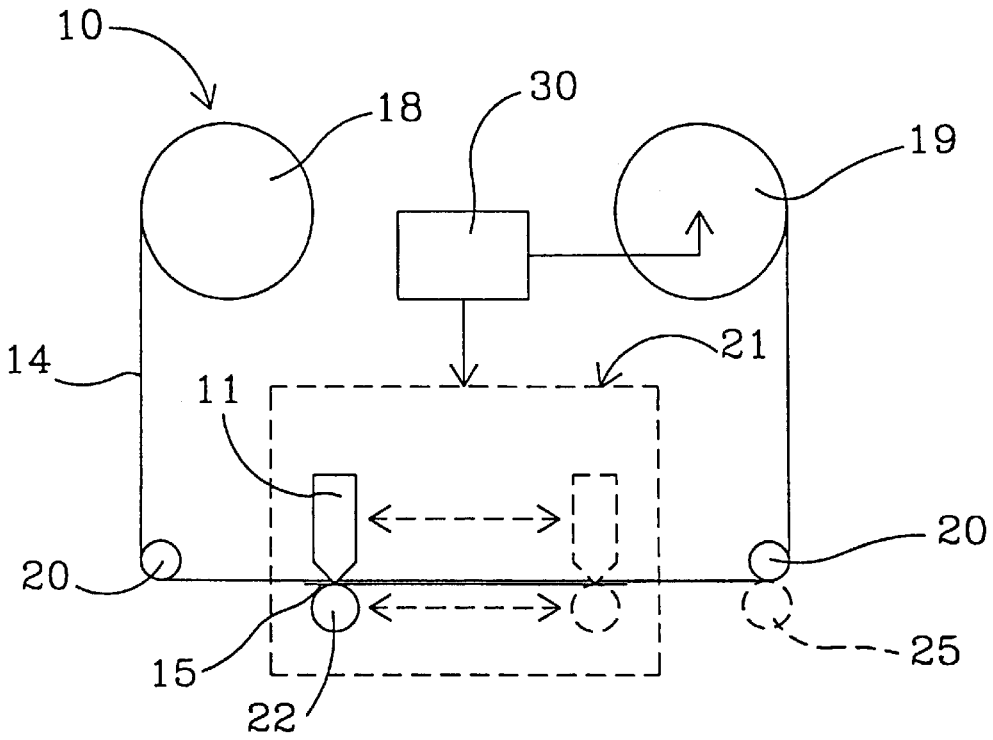
FIG. 1 is an illustrative view of one example of an apparatus which may be adapted to perform the method of the invention.
Figure 1A:
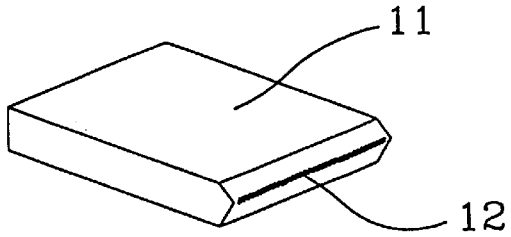
FIG. 1*a* is an illustrative enlarged view of a print head of the apparatus of FIG. 1.

Referring to FIGS. 1 and 1*a* of the drawings there is shown a printing apparatus 10 comprising a thermal print head 11 having a plurality of printing elements 12 arranged generally in an array, i.e. in this example a linear array, across the print head 11. Typically there would be about 300 such elements 12 per inch, each of which may selectively be energised and de-energised during a printing operation under computer control, so that pixels of marking medium or ink, are transferred from a carrier e.g. a ribbon 14 onto a substrate 15 which in this example comprises a label, but may comprise a product or packaging for examples.

The ribbon 14 is stored on a storage spool 18, and passes along a ribbon path to a take-up spool 19 via idler rollers 20 and the like. The ribbon 14 passes through a printing station 21 where the print head 11 is located.

In the example of printing apparatus 10 shown, the substrate 15 is moved to the printing station 21, and is held stationary there whilst the print head 11 moves relative to the substrate 15 from a start position shown in full lines, to an end of print position shown in dotted lines whilst the printing elements 12 are selectively energised and de-energised as described below, to effect printing. There is provided a backing roller 22 which moves with the print head 11 to support the substrate, but in another example a platen may be provided.

At the end of a printing operation, the print head 11 is returned to the start position and fresh substrate 15 is moved to the printing station 21. Also, the ribbon 14 is wound on so that fresh ribbon is positioned at the printing station 21, so that another printing operation may be carried out. The print head 11 movement may include a movement towards the substrate 15 for printing, and a movement away from the substrate 15 after printing.

The ribbon 14 may be moved by a capstan drive arrangement (using a capstan wheel as shown in dotted lines at 25), the take-up spool 19 merely taking up the ribbon 14, or the take-up spool 19 may be driven e.g. by a stepper motor, to move the ribbon. Further alternatively a shuttle may be used to move the ribbon 14.

In another arrangement, the substrate 15 need not be stationary during, printing but may be moved whilst the print head 11 may be stationary or moving. The ribbon 14 need not be stationary during printing, but may be moving.

Thus the apparatus may include any of the drive and/or ribbon saving features described and claimed in our previous patent applications WO96/32258, WO97/18089, WO97/36751 and EP0683055.

In another arrangement, the substrate may have a thermally sensitive layer, pixels of which are activated by the thermal printing elements, to effect printing. Thus the ribbon 14 would not be required.

It will be appreciated by those skilled in the art that the speed at which a printing operation may be carried out is restricted by the speed at which the printing elements 12 of the print head 11 can be energised and de-energised, i.e. thermally cycled and the sensitivity of the heat sensitive surface or medium. Conventionally the print head 11 is moved relative to the substrate 15 during the printing operation in steps by a stepper motor. For each step moved, a control means 30 selects the printing elements 12 to energise and then deenergise so that the image printed during the printing operation is made up of a plurality of rows and columns of pixels.

Using a print head 11 having R printing elements 12 per unit length, an image having a resolution of R times C is conventionally printed, where C is the number of columns of pixels, equal to the number of steps moved along a unit length of the image in a time period T (i.e. the linear resolution), which conventionally is the same as the number of print head thermal cycles performed in time period T.

It is not possible to print an image of length L to this resolution in a printing operation time of less than L/SN seconds where S is the minimum print head thermal cycle time demanded by the printing operation and N is the number of columns of the image.

Figure 2:
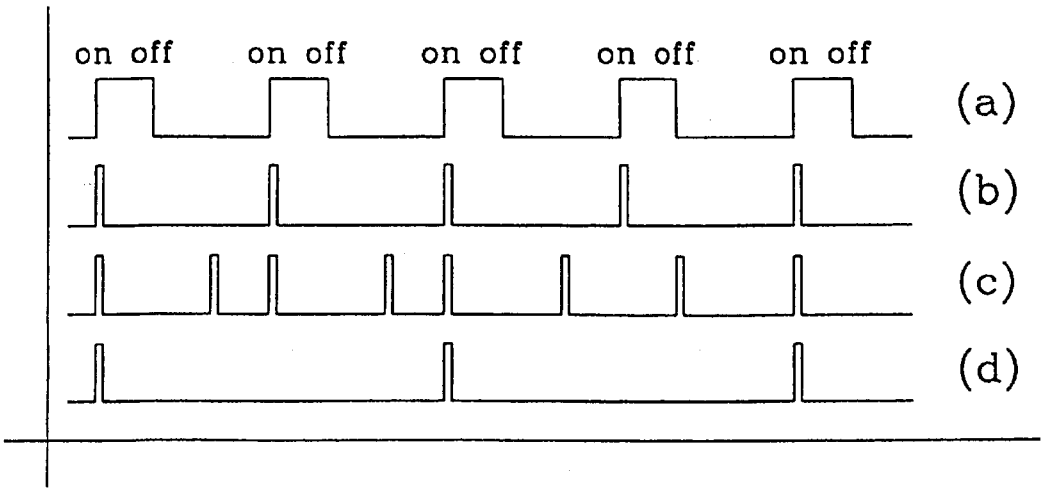
FIG. 2 is a graphical illustration showing relative print head movement during print head thermal cycles.

In FIG. 2(*a*) there is shown for pair of a printing operation, how in a time period T the print head 11 is thermally cycled. Although there will be a physical heating up and cooling down time, the points at which energy is provided to the selected printing elements 12 as the print head 11 moves relative to the substrate 15 are indicated as "on" and although there will be a physical cooling down time, the points at which the printing elements 12 are de-energised, are indicated by "off".

In FIG. 2(*b*) there is shown for the same time period P, how the print head 11 is conventionally relatively moved in steps.

It can be seen that relatively stepped movement of the print head 11 is commenced in concert with the selected printing elements 12 being energised. The steps of movement can be performed very quickly indeed which is why they are indicated in FIG. 2*b* by simple spikes. The print head 11 is thus stationary relative to the substrate 15 in this example while the printing elements 12 heat up and cool down. However if desired, relative movement may be effected earlier on in the de-energisation stage than indicated.

The softened pixels of the ribbon, corresponding in position to the positions where the printing elements 12 are energised, may be removed from the ribbon 14 and transferred onto the substrate 15 during print head 11 movement by the action of a peeler bar or the like, where as the pixels further cool, they will become adhered to the substrate 15.

In printing an image of length L, for each thermal cycle, the print head will be relatively stepped a distance of L/C and thus the overall printing time to print the image length L will be L/SN.

Referring now to FIG. 2(*c*) one method by which the printing apparatus 10 may be operated in accordance with the invention is graphically illustrated.

To print an image of length L, data is provided to the control means 30. Ordinarily the data would enable an image of length L to be printed to the resolution RC if sufficient time was available for C thermal cycles to be performed, per unit length.

Assuming that it is desired to print the image of length L in an available time T less than that required for the thermal print head 11 to be thermally cycled such as to produce an image to an overall resolution of RC, or at least linear resolution C, the control means 30 manipulates the data provided thereto to print the image with some data missing, particularly, with some of the columns of pixels missing in the direction of print head movement.

Using this method, the overall printing time will be reduced, albeit at the expense of image resolution. In this method for each of the print head thermal cycles shown in time period T, the print head 11 is relatively stepped twice and each step causes print head 11 movement of the same magnitude as the steps shown in FIG. 2(*b*). Because it is not possible to energise, and de-energise the printing elements 12 for each such print head 11 step of movement, only alternate columns of pixels will be resolved. As a result, an image having a resolution of R times C/2 in this example will be printed. For the whole image, the overall printing operation time will thus be reduced by half, to L/2SN.

Again, relative stepped print head movement is commenced in conceit with energising of the selected printing elements 12 of the print head 11, but an additional step of movement occurs for each thermal cycle so that the print head 11 is moved by the two steps, to the next but one pixel column position where the printing elements 12 may be re-selected and the re-selected printing elements 12 energised, i.e. another thermal cycle performed.

In this way, it will be appreciated that compared to a conventional printing method, the number of steps required to move the print head 11 over image length L will be the same as in a conventional printing method, but the number of thermal cycles performed by the print head will be halved, which will result in a doubling of the overall print speed for the printing operation.

In another example, more than one exit-a step of movement may be performed for each thermal cycle depending on the time T available to print the image. Where more time is available than is required for printing only alternate columns, image resolution may be improved by printing some of the image conventionally, i.e. by causing a single relative stepping movement of the print head 11 in concert with at least one of the print head thermal cycles during a printing operation, and printing other parts of the image by causing relative stepping movement of the print head across two or more of the image columns.

Generally, where less time is available to print the image of length L than that required for the thermal print head 11 to be thermally cycled such as to produce an image to a resolution of RC, relative movement between the print head and the substrate is caused such that the print head relatively traverses the substrate the image length L in the available time T whilst the print head performs E thermal cycles to print the image, and the control means manipulates the data so that the image is printed with the print head omitting at least some of the columns of pixels so that the image has R rows per unit length and Z columns per unit length, where Z is less then C.

In another arrangement in which the print head 11 and substrate 15 undergo stepped relative movement during printing, the available time T to print the image of length L may be so great that if one thermal cycle was performed to print C columns of pixels, the efficiency of the high speed print head 11 may be impaired. Thus in FIG. 2*d* there is shown a print cycle in which C columns per unit length are printed along the image length, but the print head undergoes two thermal cycles for each step of movement. Because pixels are printed in the column positions as a result of the first of the two thermal cycles, the second thermal cycle does not result in the actual printing of further pixels, and so the resultant image resolution is RC notwithstanding that print head 11 may have performed greater than C thermal cycles.

Although the invention has been described in particular in relation to an arrangement in which the print head 11 undergoes stepped movement relative to the substrate 15 or the substrate 11 is stepped relative top the print head 11 during printing, the invention may be applied to an arrangement in which continuous relative movement takes place e.g. using a synchronous drive or the like. In this event the control means 30 will, depending on the time T available to print the image of length L, cause the print head 11 relatively to traverse the substrate 15 during printing so as relatively to move the print head 11 the length L while the print head 11 performs E thermal cycles, preferably being the maximum number of cycles the print head can perform in time T.

Thus again where less time is available for printing than is needed for printing to resolution RC, the control means 30 will manipulate the data provided thereto to print the image at a reduced resolution RZ by omitting some of the columns of pixels which according to the data provided, would otherwise enable the image to be printed to a resolution of RC.

If the thermal print head is thermally cycled more often that the number of columns C, extra columns of pixels will need to be printed, and conveniently the previous column of pixels may be repeat printed.

What is claimed is:

1. A method of printing using, a thermal print head including a plurality of printing, elements arranged generally in an array each of which are selectively thermally cycled between an energiseable and de-energiseable state under the control of a controller to transfer pixels of marking medium from a carrier onto a substrate or to activate pixels on a sensitive substrate and form an image, the print head having a characteristic thermal cycle time, the method comprising providing to the controller data dependent on the nature of the image to be printed which would enable the image having an image length L to be printed as a matrix of pixels at a linear resolution of C where C is the number of image columns per unit length in the direction of printing, providing to the controller a time T which is available for printing the image on the substrate; and causing relative movement between the print head and the substrate such that the print head relatively traverses the substrate the image length L in an available time T whilst the print head performs a number of thermal cycles E to print the image, with the print head omitting or repeat printing at least some of the columns of pixels so that, where the available time T to print the image is greater than that required by the print head to perform sufficient thermal cycles to print an image to linear resolution C, the controller causes columns of pixels to be repeat printed along the image length L or where the available time T to print the image is less than that required for the print head to perform C thermal cycles per unit length, the controller causes at least some of the columns of pixels to be omitted.

2. A method according to claim 1 wherein the number of columns of printed per unit length Z is not equal to the number of columns C per unit length contained in the data provided to the controller.

3. A method according to claim 1 or claim 2 wherein relative movement between the print head and the substrate is performed in stepped manner, the control means relatively stepping the print head A times to move the print head the image length L in the time available to print the image, where A is not equal to the number of thermal cycles E performed by the print head in the time available T.

4. A method according to claim 3 wherein the number of steps of movement of the print head A is greater than the number of thermal cycles E performed by the print head in the available time T to print the image so that the controller omits columns from the image so that the resultant image has a number of columns per unit length Z at is less than the linear resolution C.

5. A method according to claim 3 wherein the number of steps of movement of the print head A is less than the number of thermal cycles E performed by the print head in the available time T to print the image so that the controller repeats print at least some of the columns of pixels so that the resultant image has a linear resolution of C.

6. A method according to claim 1 or claim 2 wherein the relative movement between the print head and the substrate is constant during the available time T to print the image.

7. A method according to claim 6 wherein the available time T to print the image is greater than that required by the print head to perform sufficient thermal cycles to print an image to linear resolution C, the controller causes columns to be repeat printed along the image length L so that Z is greater than C.

8. A method according to claim 6 wherein where the available time T to print the image is less than that required for the print head to perform C thermal cycles per unit length, the controller omits at least some of the columns of pixels so that a reduced resolution image is produced.

9. The method of claim 1 comprising providing a substrate on a production line as an article which is passed through a printing station and wherein the time T is dependent on the time the article is in the printing station.

10. The method of claim 1 providing a print head that is stationary and relative movement is achieved by moving the article past the print head, the time T being dependent on the rate of article movement.

11. The method of claim 1 comprising providing an article that arrives at the printing station and is stationary and relative movement is achieved by moving the print head, the time T being dependent on the dwell time of the article at the station.

12. A printing apparatus comprising:

a thermal print head having a plurality of printing elements arranged in an array, the print head having a characteristic thermal cycle time a controller that selectively energises and de-energises the printing elements to transfer pixels of marking medium from a carrier onto a substrate or to activate pixels of a sensitive substrate, a printing station where relative movement between the print head and substrate in a printing direction is effected whilst the thermal print head performs thermal cycles to print an image of image length L, wherein the controller is provided available time T and is adapted to receive data which would enable an image having an image length L to be printed at a linear resolution of C where C is the number of image columns per unit length in the direction of printing, and to control the printing elements so that as the print head relatively transverses the substrate the image length L in available time T, whilst the print head performs a number of thermal cycles E to print the image, the image is printed with the print head omitting or repeat printing at least some of the columns so that, where the available time T to print the image is greater than that required by the print head to perform sufficient thermal cycles to print an image to linear resolution C, the controller causes columns of pixels to be repeat printed along the image length L or where the available time T to print the image is less than that required for the print head to perform C thermal cycles per unit length the controller causes at least some of the columns of pixels to be omitted.

13. The apparatus of claim 12 wherein the substrate is on a production line and comprises an article which is passed through a printing station and wherein the time T is dependent on the time the article is in the printing station.

14. The apparatus of claim 13 wherein the print head is stationary and relative movement is achieved by moving the article past the print head, the time T being dependent on the rate of article movement.

15. The apparatus of claim 13 wherein the article arrives at the printing station and is stationary and relative movement is achieved by moving the print head, the time T being dependent on the dwell time of the article at the station.

* * * * *